US005231255A

United States Patent [19]

Reichensperger

[11] Patent Number: 5,231,255

[45] Date of Patent: Jul. 27, 1993

[54] ELECTRIC FLOAT SWITCH COMPRISING AN ELECTRIC CONNECTION CABLE

[76] Inventor: Gunter Reichensperger, Am Strebkamp 24, D-4800, Bielefeld, Fed. Rep. of Germany

[21] Appl. No.: 807,268

[22] Filed: Dec. 16, 1991

[30] Foreign Application Priority Data

Dec. 14, 1990 [DE] Fed. Rep. of Germany ..... 4039939

[51] Int. Cl.[5] ..... H01H 35/18

[52] U.S. Cl. ..... 200/84 R; 73/313; 174/77 R; 428/217; 428/516

[58] Field of Search ..... 428/217, 516; 307/118; 174/76, 74 R; 200/84 R, 84 A, 84 B, 84 C; 340/623, 624; 73/308, 313, 318, 321

[56] References Cited

U.S. PATENT DOCUMENTS 4,560,598 12/1985 Cowan ..... 428/516
4,567,069 1/1986 Jabarin ..... 428/516
4,692,576 9/1987 Frede ..... 200/84 R
4,878,969 11/1989 Janisch ..... 428/217
4,888,989 12/1989 Homer ..... 73/304 C
5,089,676 2/1992 Duncan ..... 200/84 R

*Primary Examiner*—Gerald P. Tolin
*Attorney, Agent, or Firm*—Burns, Doane, Swecker & Mathis

[57] ABSTRACT

The invention is an electric float switch with an electric connection cable whose sheath surrounds current-carrying electric conductors that are insulated relative to each other, and which is sealingly connected to the casing of said float switch, characterized in that a) the sheath of said prefabricated cable is made from a softly adjusted polypropylene prepared from a thermoplastic polypropylene granule mixture that is not cross-linked;

b) and that said sheath is connected in one operation in an injection molding machine to said casing which accommodates said prefabricated float switch and consists of rigidly adjusted polypropylene, whereby a connecting component of rigidly adjusted polypropylene granule is formed.

7 Claims, 1 Drawing Sheet

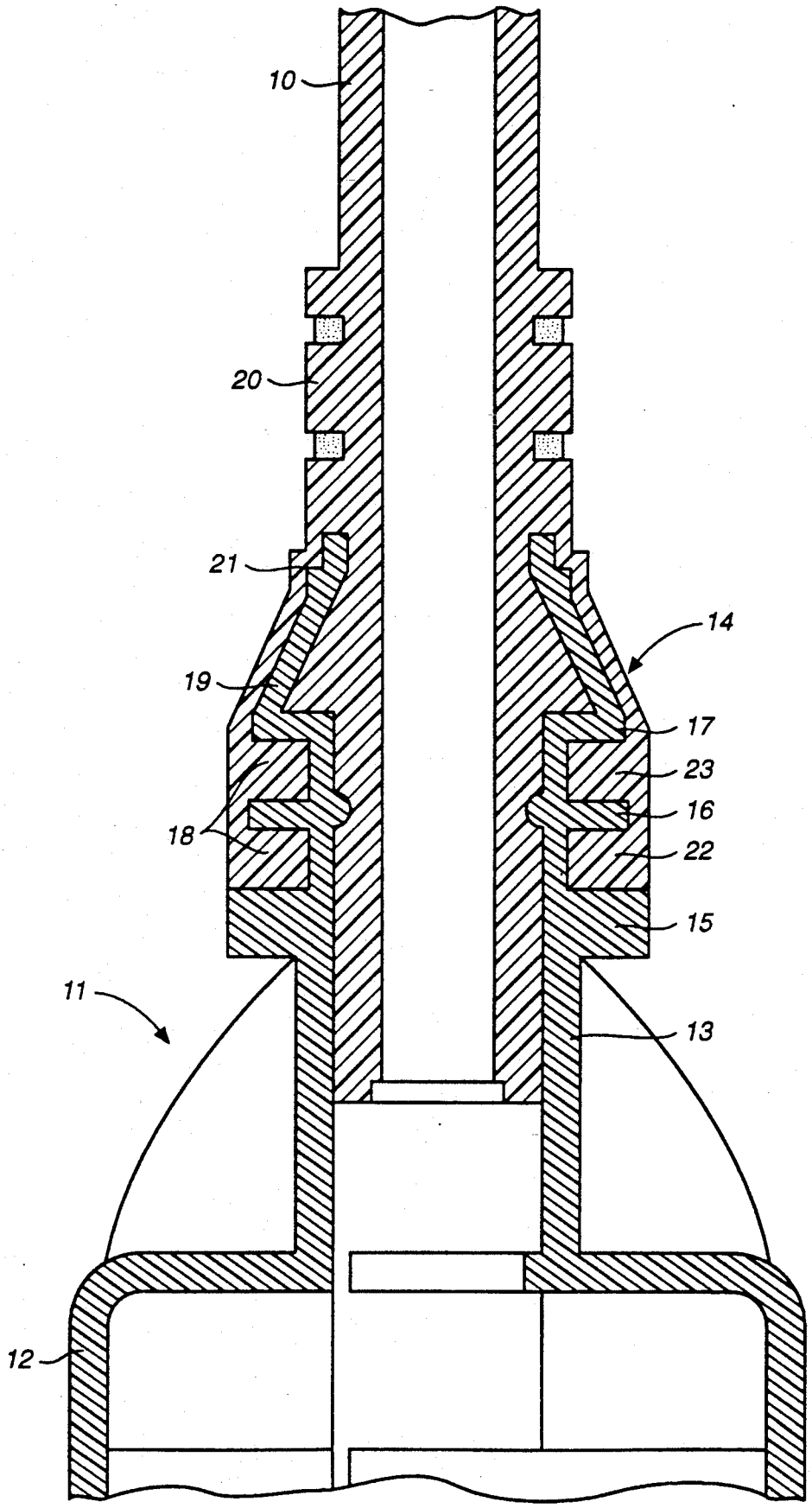
10
20
21
14
19
17
23
16
18
22
15
11
13
12

ELECTRIC FLOAT SWITCH COMPRISING AN ELECTRIC CONNECTION CABLE

BACKGROUND OF THE INVENTION

This invention relates to an electric float switch comprising an electric connection cable whose sheath surrounds current-carrying electric conductors that are insulated relative to each other, and which is sealingly connected to the casing of the switching device (float switch).

Since the sheath of an electric cable and the casing of an electric float switch have so far consisted of different materials as a rule, perfectly liquid-tight connections could only be accomplished at a considerable amount of technical equipment. This, however, entails the risk that leakage will be observed with respect to the ambient liquid after a certain period of service and the pull-off strength of the interconnected members will decrease.

As far as it is already known from printed publications that an electric cable with a sheath of polyurethane is connected by welding to an electric plug body consisting also of polyurethane, such welds do not remain impermeable to aggressive liquids in the long run and are therefore not suited for use as float switches, not to mention the fact that any special information cannot be found in these publications about the employed polyurethane that is available on the market in a great number of types.

SUMMARY OF THE INVENTION

It is the object of the present invention to provide an electric float switch which includes a cable connection and consists of few individual components, wherein the cable sheath is in liquid-tight and tear-resistant communication with the material of the connected casing of the switch, with a connecting component being formed in an injection molding machine. The connection between the prefabricated cable (cable sheath) and the float switch casing to be connected thereto is to be established in an easy way by injection molding in one operation at a certain pressure and temperature.

As for an electric float switch with a cable connection of the above-mentioned type, this object is accomplished in that the sheath of the prefabricated cable consists of a softly adjusted polypropylene made from a thermoplastic polypropylene granule mixture which is not cross-linked, and in that the sheath is connected in one step in an injection molding machine to the casing of rigidly adjusted polypropylene for the prefabricated float switch to form a connecting component of rigidly adjusted polypropylene granule.

Surprisingly enough, it has been found in troublesome tests that the thermoplastic material polypropylene (as PTE) is especially suited because it withstands in its component connection to the attack or penetration of liquids and exhibits a great impact strength.

In a preferred embodiment of an electric cable with a float switch casing being attached thereto in liquid-tight fashion, the sheath of the cable may consist of the above-mentioned soft PTE with admixed rubber granule while the casing is made from a polypropylene granule as the rigid thermoplastic. The sheathed prefabricated cable is inserted at one end into a mold of an injection molding machine and, with the introduced polypropylene granule (of rigid adjustment), it is connected by injection molding at a certain pressure and a certain temperature to the casing of the prefabricated float switch under formation of a connecting component. The soft sheath of the flexible electric cable and the connecting component, respectively, are bonded to the material of the rigid casing of the float switch. This bond does not tear upon the occurrence of tensile forces and is and remains impermeable to liquids.

Hence, in the connection area between the sheath of the prefabricated cable and the preliminarily injection-molded casing of the float switch, one obtains a single connecting component which meets the demands made, e.g., on an economic manufacture, a lightweight component, corrosion resistance and impermeability to liquids. The manufacturing process thus comprises three steps wherein the already fabricated cable sheath (step 1) and the casing (step 2) of the float switch have the connecting component placed around the inlet part of the casing with the attached cable by injection molding in one operation (step 3).

The casing of the float switch consists of two rigid shells of polypropylene which are covered in the known manner on their edge by means of a surrounding sealing strip and are sealed thereby. This strip is also made from the rigid material polypropylene of the connecting component.

The connection of the sheath of the cable to the casing, which forms one component, withstands all stresses arising in wet, moist and wet rooms, especially when permanently placed in water—as for float switches, in both industrial water and aggressive dirty water. The tensile strength remains even after aging over 100° C.

Surprisingly enough, due to the use of soft polypropylene for the sheath of the cable and of rigid polypropylene for the casing injection-molded therearound, the molecules of the peripheral layers of all three components are chemically bonded during injection molding in a mold, so that a uniform, previously unknown float switch with cable connection is formed, of which all members exhibit the excellent novel property. The liquid (water) absorption of the cable sheath is substantially smaller than in a rubber sheath of the known type.

This electric cable with the float switch casing being injection-molded around the inlet side may, e.g., be used in submerged pumps or other members which are permanently placed in water.

Other features of the invention will become apparent from the subclaims.

An embodiment of the invention is illustrated in the single figure of the drawing. This figure is a cross-sectional view of a sheath 10 of an electric cable which is connected to a cable inlet member 11 of a casing 12 of a float switch in an injection molding machine such that the connection withstands tensile stress and is impermeable to liquids, with a single overall component being formed.

DETAILED DESCRIPTION OF THE INVENTION

The material of the casing 12 of the float switch consists of rigidly adjusted polypropylene, as depicted by the short lines inclined to the right. The material of the sheath 10 of the electric cable is softly adjusted polypropylene, with the starting granule preferably containing an added amount of softly adjusted rubber granule.

The added rubber granule may contain synthetic rubber.

The casing 12 narrows at one end into a mouthpiece 13 which has the end of the sheath 10 partly inserted thereunto.

The mouthpiece 13 projects from the casing 12 and forms a flange member 14 with a plurality of outwardly projecting spaced-apart rings 15, 16, and 17 that form an outwardly open annular chamber 18.

A conical clamping ring 19 projects from the outer rib-like ring 17. The clamping ring terminates shortly before an anti-kink sleeve 20 that forms the transition to the free sheath 10 of the cable. A coupling ring 21 projects from this anti-kink sleeve 20 towards the casing 10 and first surrounds the conical clamping ring 19 and then protrudes with retaining flanges 22, 23 into the annular chamber 18 which is filled thereby.

The end portion of the sheath 10, the bridging anti-kink sleeve 20 and the protruding coupling ring 21, which forms the outer wall of the connecting member between sheath 10 and casing 12, are depicted by short lines inclined to the left, and form a uniform component of polypropylene whose inner boundary surfaces defining the flange member 14 are chemically interlocked at a certain temperature and under a certain high pressure in an injection molding machine (in a molecular way) such that they carry, on the one hand, the tensile forces occurring between electric cable and casing of the float switch without any crack formation and are, on the other hand, impermeable to aggressive liquids.

Hence, a bonding which is unparalleled and meets all demands made on the mechanical and chemical properties and which assures a long service life as water absorption is very low, especially in the case of permanent storage in a liquid, is thereby achieved from the rigid (impact-resistant) float switch casing 12 of rigid polypropylene and the outwardly extending flexible electric cable (with soft adjustment of the sheath).

The sealing strip (not shown) which surrounds the casing 12 as part of the unit (anti-kink sleeve 20, coupling ring 21, retaining flanges 22, 23) is formed of rigid polypropylene just like this unit and the casing 12.

At a high pressure in the injection molding machine, the polypropylene granule which first liquifies can also flow into the chamber 24 of the casing 12 at the end of the cable sheath 10 and thermoplastically harden in said chamber, with the latter being filled thereby either entirely or partly.

What is claimed is:

1. In an electric float switch of the type including a prefabricated electric connection cable whose sheath surrounds current-carrying electric conductors that are insulated relative to each other, the improvements comprising:

a) the sheath of said prefabricated cable comprising a softly adjusted polypropylene prepared from a thermoplastic polypropylene granule mixture that is not cross-linked; and b) said sheath is sealably connected to said casing which accommodates said prefabricated float switch and which comprises a rigidly adjusted polypropylene, whereby a connecting component of rigidly adjusted polypropylene granule is formed.

2. The float switch according to claim 1, wherein the sheath is made from a polypropylene granule comprising an added soft synthetic rubber granule.

3. The float switch according to claim 1 wherein the granule mixture for said sheath consists of fine grains.

4. The float switch according to claim 1 wherein the granule mixture of said sheath has added thereto a small amount of preliminarily crosslinked EPM (ethylene-propylene-diethylene) granule.

5. The float switch according to claim 1 wherein the amount of said preliminarily cross-linked EPM is about 3–6%.

6. The float switch according to claim 1 wherein a peripheral strip which seals the two shells of said float switch is simultaneously injection-molded together with said connecting component.

7. The float switch according to claim 1 wherein the sheath is connected to the casing in one operation in an injection molding machine.

* * * * *